United States Patent [19]

Smith et al.

[11] 4,174,328

[45] Nov. 13, 1979

[54] FLAME RETARDED NON-WOVEN TEXTILE MATERIAL COMPRISED OF FLAME RETARDANT AND VINYL CHLORIDE LATEX

[75] Inventors: Ray E. Smith; Jayendra G. Shukla, both of Ann Arbor, Mich.

[73] Assignee: Velsicol Chemical Corporation, Chicago, Ill.

[21] Appl. No.: 934,123

[22] Filed: Aug. 16, 1978

[51] Int. Cl.[2] ..... C08L 1/02

[52] U.S. Cl. ..... 260/17.4 CL; 260/45.95 G; 260/9

[58] Field of Search ..... 260/17.4 CL, 9

[56] References Cited

U.S. PATENT DOCUMENTS

| | | | |
|---|---|---|---|
| 3,874,155 | 4/1975 | Knopka | 260/9 |
| 3,907,744 | 9/1975 | Anderson | 260/45.9 R |
| 3,989,531 | 11/1976 | Orlando | 260/45.95 G |

*Primary Examiner*—Edward M. Woodberry
*Attorney, Agent, or Firm*—D. Olesch; H. G. Greenwald; R. J. Schwarz

[57] ABSTRACT

There is provided a flame-retarded non-woven material which contains a mixture of flame retardant and vinyl chloride latex, wherein said flame retardant is selected from the group consisting of

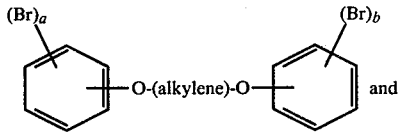

I

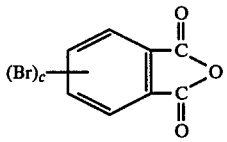

II wherein a and b are integers independently selected from the group consisting of 1, 2, 3, 4 and 5, a plus b is from about 6 to about 10, c is an integer of from 1 to 4, and alkylene is a straight chain carbon group having from one to six carbon atoms; and wherein more than 50 percent (by weight) of said flame retardant consists of particles with a diameter of from about 2 to about 25 microns.

8 Claims, No Drawings

FLAME RETARDED NON-WOVEN TEXTILE MATERIAL COMPRISED OF FLAME RETARDANT AND VINYL CHLORIDE LATEX

FIELD OF THE INVENTION

A flame-retarded nonwoven fabric material is disclosed.

DESCRIPTION OF THE PRIOR ART

Nonwoven textiles have found a wide variety of commercial applications. By way of illustration, they are used, e.g., in sound absorbing insulation applications and in padding applications. One of the many important uses for these materials is as the padding in automotive roofs, dashboards, and trim panels.

The National Highway Safety Bureau of the United States Department of Transportation has promulgated Motor Vehicle Safety Standard No. 302, "Flammability of Interior Materials—Passenger Cars, Multipurpose Passenger Vehicles, Trucks, and Buses". This standard appears in part 471 of Title 49 of the Code of Federal Regulations and was published in the Jan. 8, 1971 issue of the Federal Register (Vol. 36, No. 5); M.V.S.S. 302 requires that automotive parts meet its burn resistance requirements.

A prior art nonwoven textile padding material which was used in automotive trim panels was comprised of polyester and viscose rayon; it was produced by a process wherein a web of polyester and viscose rayon fiber was formed by air laying the fibers, the web was needle punched, the web was sprayed with a mixture containing polyvinyl chloride latex and antimony oxide, and and the web was dried. One of the disadvantages of this material is that antimony oxide is often in short supply, most of it is imported from foreign countries, and its particle size is often non uniform.

Nonwoven materials can be flame retarded with many prior art flame retardants so that they possess the requisite degree of inflammability; however, many of these materials cannot be dielectrically bonded to a thermoplastic material or a backing support and retain a bond strength sufficiently high to be commercially useful.

Applicants have discovered a new flame-retarded nonwoven material which meets M.V.S.S. standard 302 and which forms a strong and durable bond with thermoplastic materials.

SUMMARY OF THE INVENTION

In accordance with this invention, there is provided a flame-retarded non-woven material which contains a mixture of flame retardant and vinyl chloride latex, wherein said flame retardant is selected from the group consisting of

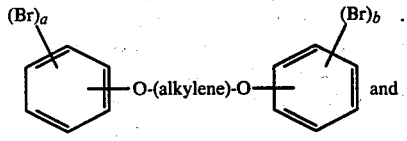

I

-continued

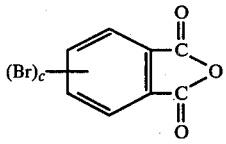

II wherein a and b are integers independently selected from the group consisting of 1, 2, 3, 4 and 5, a plus b is from about 6 to about 10, c is an integer of from 1 to 4, and alkylene is a straight chain carbon group having from one to six carbon atoms; and wherein more than 50 percent (by weight) of said flame retardant consists of particles with a diameter of from about 2 to about 25 microns.

The nonwoven fabric material which may be used in the composition of this invention is well known to those skilled in the art. For the purpose of this specification, the term "nonwoven fabric" encompasses pliable and porous products from textile elements that are reinforced by mechanical or chemical means. See, e.g., the article appearing on pages 345–355 of Volume 9 of the Encyclopedia of Polymer Science and Technology (Interscience, New York, 1968) which is hereby incorporated by reference.

It is preferred that the nonwoven fabric material used in the composition of this invention contain fiber selected from the group consisting of cellulosic fiber, modacrylic fiber, nylon fiber, polyester fiber, and mixtures thereof. It is more preferred that said fiber be selected from the group consisting of polyester fiber, rayon fiber, and mixtures thereof.

The nonwoven fabric material of this invention contains a mixture of flame retardant and vinyl chloride latex. Latex is a colloidal suspension of polymer particles in water. Some latexes are described in the article appearing on pages 164–194 of Volume 8 of the Encyclopedia of Polymer Science and Technology (Interscience, New York, 1968); this article and the publications cited in it are incorporated by reference into this publication.

The preferred vinyl chloride latexes are uniform colloidal dispersions of vinyl chloride polymers and copolymers in water. Some of these vinyl chloride latexes are marketed under the name of Geon® Vinyl Chloride Latexes by the B. F. Goodrich Chemical Company of Cleveland, Ohio.

Vinyl chloride latexes may be produced by emulsion polymerization in order to form the polymer into small particles dispersed in water. Emulsifiers, buffers, and protective colloids may be used in the process of preparing these preferred latexes.

Anionic, nonionic, and cationic emulsifiers may be used to stabilize liquid monomer droplets formed by agitation; polymerization takes place in these droplets to form the solid, dispersed particles of polymer in water. It is preferred to use anionic or nonionic emulsifiers; sodium lauryl sulfonate and alkyl aryl polyether alcohols are examples of the former and latter, respectively.

The specific gravity of the preferred vinyl chloride latexes is from about 1.0 to about 1.5. In the most preferred embodiment, the specific gravity is from about 1.1 to about 1.3.

It is preferred that vinyl chloride latexes used in the composition of this invention be plasticized with plasticizers well known to those skilled in the art. Some of the plasticizers which may be used in the composition of this invention include, e.g., di(2-ethylhexyl)adipate; acetyl tri-n-butyl citrate; epoxy derivatives (including epoxidized soy bean oil, tallate esters); chlorinated paraffin; tricresyl phosphate; alkyl aryl phosphate; mixed alcohol phthalate; di(2-ethylhexyl)phthalate; didecyl phthalate; butyl benzyl phthalate; and the like. Other plasticizers well known to the art also may be used.

A preferred class of plasticizers is the phthalate plasticizers containing alcohol chains containing at least 8 carbon atoms per chain such as, e.g., dioctyl phthalate, dinonyl phthalate, didecyl phthalate, and the like.

The flame retardant used in the composition of this invention is selected from the group consisting of

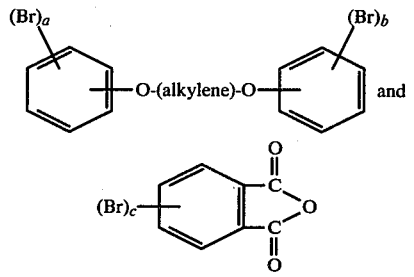

I

II wherein a and b are integers independently selected from the group consisting of 1, 2, 3, 4, and 5, a plus b is from about 6 to about 10, c is an integer of from 1 to 4, and alkylene is a straight chain carbon group having from one to six carbon atoms; and wherein more than 50 percent (by weight) of said flame retardant consists of particles with a diameter of from about 2 to about 25 microns. It is preferred that more than 50 percent (by weight) of said flame retardant consists of particles with diameters of from about 2 to about 15 microns. It is preferred that a and b be independently selected from the group consisting of 2, 3, and 4 and c be from 3 to 4. In the most preferred embodiment, a plus b are 6 and c is 4.

It is preferred that the vinyl chloride latex mixture used in the composition of this invention contain from about 4 to about 30 percent (by combined dry solids weight of latex and flame retardant) of said flame retardant. In a more preferred embodiment, the latex mixture contains from about 7 to about 20 percent (by dry solids weight) of said flame retardant.

In the bis-bromophenoxy compounds described by formula I, alkylene is a straight chain carbon group having from 1 to 6 carbon atoms, and includes, without limitation, groups such as $—CH_2—$; $—(CH_2)_2—$; $—(CH_2)_3—$; $—(CH_2)_4—$; $—(CH_2)_5—$; and $—(CH_2)_6—$.

Some non-limiting examples of the compounds described by Formula I are: 1,1-bis(2,4,6-tribromophenoxy)methane; 1,2-bis(2,4,6-tribromophenoxy)ethane; 1,3-bis(2,4,6-tribromophenoxy) propane; 1,4-bis(2,4,6-tribromophenoxy) butane; 1,5-bis(2,4,6-tribromophenoxy) pentane; 1,6-bis(2,4,6-tribromophenoxy) hexane; 1,1-bis(3,4,5-tribromophenoxy) methane; 1,2-bis(3,4,5-tribromophenoxy) ethane; 1,3-bis(2,4,5-tribromophenoxy) propane; 1,3-bis(2,3,4-tribromophenoxy) propane; and 1,1-bis(2,3,6-tribromophenoxy) propane.

The bis tribromophenoxy compounds containing bromine substituents in the 2,4,6 positions are preferred from the standpoint of ease of production.

In general, the bis-bromophenoxy compounds are prepared by reacting a halogenated phenol with a halogenated alkane at elevated temperatures in the presence of a basic material such as alkali metal hydroxides, carbonates, bicarbonates, oxides and hydrides. The preferred alkali metals are potassium and sodium. Where one desires to increase, for example, ease of handling the reaction mass, solvents such as ketones (e.g., acetone, methyl ethyl ketone and methyl iso-butyl ketone), alcohols (e.g., methanol, ethanol, iso-propyl alcohol, butyl alcohol and glycols), or aqueous solvents (e.g., water, a mixture of water and alcohol and a mixture of water and ketone) can be employed. The desired end products, i.e., the bis-tribromophenoxy compounds, can be recovered from the reaction mass via various methods known to those skilled in the art. Where the end product requires recovery via crystallization, various aromatic solvents, such as benzene, toluene, xylene, dichlorobenzene and the like, can be used.

The bis-bromophenoxy compounds may be prepared according to the following reaction scheme;

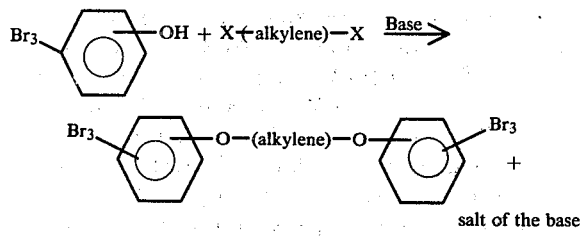

In the above reaction, X is halogen, preferably bromine.

The above reaction is conducted at temperatures ranging from the freezing point of the initial reaction mass to the boiling point thereof. Preferably the temperatures are from about 40° C. to about 200° C. and more preferably from about 50° C. to about 175° C. It is to be understood that the reaction can be conducted under subatmospheric (e.g., 1/10–8/10 atmospheres) pressure. Preferably, the reaction is carried out at atmospheric pressure.

The above described processes can be carried out with conventional, readily available chemical processing equipment. For example, a conventional glass-lined vessel provided with heat transfer means, a reflux condenser and a mechanical stirrer can be advantageously utilized.

The compound described by formula II is known by those skilled in the art. It may be prepared, e.g., by brominating phthalic anhydride.

More than 50 percent (by weight) of the flame retardant used in the composition of this invention consists of particles with a diameter of from about 2 to about 25 microns; it is preferred that more than 50 percent (by weight) of the flame retardant consist of particles with a diameter of from about 2 to about 10 microns. Techniques well known to those skilled in the art, such as, e.g., micronization, may be utilized to insure that said flame retardant has the proper particle size distribution.

In a preferred embodiment, the non-woven fabric material of this invention contains from about 10 to about 90 percent dry solids (by combined weight of nonwoven fabric and latex mixture) of said latex mixture. It is preferred that said fabric material contain from about 20 to about 80 percent dry solids of said latex mixture. It is more preferred that said fabric material contain from about 30 to about 70 percent of said latex mixture. In the most preferred embodiment, said fabric material contains from about 55 to about 65 percent dry solids of said latex mixture. The "percent dry solids" (which is also referred to as the "dry solids add on" in this specification) may be calculated according to the following formula:

$$\text{Percent Dry Solids} = \frac{D.W._1 + D.W._{f.r.}}{D.W._1 + D.W._{f.r.} + D.W._f} \times 100$$

wherein:

D.W.$_1$ is the number of grams of dry solids in the latex

D.W.$_{f.r.}$ is the number of grams of dry solids in the flame retardant

D.W.$_f$ is the number of grams of dry solids in the untreated nonwoven fabric. The "percent dry solids" also is equal to the number of grams of dry solids in the latex mixture times 100 divided by the number of grams of dry solids in the treated fabric.

The latex mixture may, in addition to said flame retardant, contain other additives well known to those in the latex art. Thus, e.g., the latex mixture may contain emulsifiers, buffering agents, plasticizers, and the like.

It is preferred to use the nonwoven fabric material of this invention in upholstery applications; it is especially useful as a padding material. It may be utilized as padding for any cover material such as, e.g., leather, polyvinyl chloride, natural and man made textiles, thermoplastic materials, and the like. The nonwoven fabric material of this invention is especially useful for automotive applications wherein it may be used as the padding for, e.g., upholstery and wherein a thermoplastic such as vinyl is used as its cover material.

The following examples illustrate the claimed invention but are not to be deemed limitative thereof. Unless otherwise specified, all temperatures are in degrees centigrade, all parts are by weight, all weights are in grams, and all volumes are in millimeters.

EXAMPLES 1-3

Tetrabromophthalic anhydride and 1,2-bis(2,4,6-tribromophenoxy) ethane were micronized in an Alpine Micronizer (Type 100LU manufactured by the Rudolf Joachim Elektro-Machinenbau Company of West Germany). Thereafter these flame retardants were analyzed for particle size using a Coulter Counter. The particle size distribution found is shown below.

| | % Size Distribution Diameter | | | |
|---|---|---|---|---|
| | <2 | 2-10 | 10-25 | 25-50 |
| Micronized Tetrabromo phthalic anhydride | 0 | 54.0 | 20.0 | 19.0 |
| Micronized 1,2-bis(2,4,6-tribromophenoxy) ethane | 0 | 89.0 | 8.0 | 1.0 |

A fiber blend containing 50 percent (by total weight) of poly(ethylene terephthalate) and 50 percent (by total weight) of rayon was prepared by intimately blending the polyester and rayon staple fibers. A nonwoven batting was prepared by passing the staples through a garnetting machine; the batting so produced had a density of about 2 ounces per square yard. A mixture of 100 parts of Geon ®576 latex (comprised of about 56 percent solids) and 3.75 parts of micronized tetrabromophthalic anhydride was sprayed on one side of the batting, the sprayed batting was then dried by being subjected to a temperature of 250-300 degrees Fahrenheit for about from about 1 to about 3 minutes, the batting was then sprayed on the other side with said mixture, and the batting was dried again; the dry solids add on (the dry solids weight of the latex mixture applied times 100 divided by the dry weight of the treated fabric) was 60 percent.

The treated batting was tested in accordance with the procedure described in test M.V.S.S. Standard No. 302. The samples, which measured 14.0"×4.0", had a padding weight of 5.0 ounces per square yard. Three samples were tested; the results are shown below in Examples 1-3.

| | Burn Rate, Inches/Minute | |
|---|---|---|
| Example Number | Machine Direction | Cross Direction |
| 1 | DNI* | DNI |
| 2 | DNI | DNI |
| 3 | SE* | DNI |

*"DNI" indicates that the sample did not ignite and "SE" indicates that the sample was self extinguishing.

EXAMPLES 4-6

In substantial accordance with the procedure described in Examples 1-3, polyester/rayon battings treated with micronized 1,2-(bis(2,4,6-tribromophenoxy) ethane flame retardant was prepared; with the exception of the use of a different flame retardant, substantially all of the conditions specified in Examples 1-3 were the same.

Three samples of the treated batting were tested. For both the machine and cross directions, the treated samples had a "DNI" rating in the M.V.S.S. 302 test.

EXAMPLE 7

In substantial accordance with the procedure described in Example 1, a latex mixture containing 40 parts of tetrabromophthalic anhydride, 400 parts of Geon ®latex 576, and 50 parts of water were applied to a polyester staple. The treated batting produced had a rating of "DNI" on the M.V.S.S. 302 test.

The above examples have been described in the foregoing specification for the purpose of illustration and not limitation. Many other modifications and ramifications will suggest themselves to those skilled in the art based on this disclosure. These are intended to be comprehended within the scope of this invention.

The embodiments of the invention in which an exclusive property or privilege is claimed are defined as follows:

1. A flame-retarded non-woven material comprising a mixture of flame retardant and vinyl chloride latex, wherein said flame retardant is selected from the group consisting of

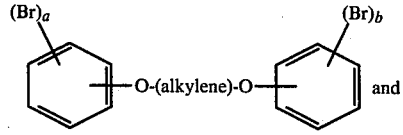

I and

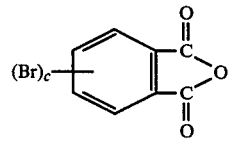

II wherein a and b are integers independently selected from the group consisting of 1, 2, 3, 4 and 5, a plus b is from about 6 to about 10, c is an integer of from 1 to 4, and alkylene is a straight chain carbon group having from one to six carbon atoms; and wherein more than 50 percent (by weight) of said flame retardant consists of particles with a diameter of from about 2 to about 25 microns.

2. The materials of claim 1, wherein said nonwoven fabric material contains fiber selected from the group consisting of cellulosic fiber, modacrylic fiber, polyester fiber, and mixtures thereof.

3. The material of claim 2, wherein said nonwoven fabric material contains fiber selected from the group consisting of polyester fiber, rayon fiber, and mixtures thereof.

4. The material of claim 3, wherein a and b are independently selected from the group consisting of 2, 3, and 4 and c is from 3 to 4.

5. The material of claim 4, wherein said latex mixture contains from about 4 to about 30 percent (by combined dry solids weight of latex and flame retardant) of said flame retardant.

6. The material of claim 5, wherein a and b are 3 and c is 4.

7. The material of claim 6, wherein said nonwoven fabric material contains from about 10 to about 90 percent (by combined weight of nonwoven fabric and latex mixture) of said latex mixture.

8. The material of claim 7, wherein said latex mixture contains from about 7 to about 20 percent (by weight) of said flame retardant.

* * * * *